US005644192A

United States Patent [19]

Ragland, Jr.

[11] Patent Number: 5,644,192

[45] Date of Patent: Jul. 1, 1997

[54] COLOR PICTURE HAVING A TENSIONED MASK AND COMPLIANT SUPPORT FRAME ASSEMBLY

[75] Inventor: Frank Rowland Ragland, Jr., Lancaster, Pa.

[73] Assignee: Thomson Consumer Electronics, Inc., Indianapolis, Ind.

[21] Appl. No.: 559,697

[22] Filed: Nov. 15, 1995

[51] Int. Cl.[6] ..... H01J 29/80

[52] U.S. Cl. ..... 313/402; 313/404; 313/407

[58] Field of Search ..... 313/402, 404, 313/407; 248/351, 357

[56] References Cited

U.S. PATENT DOCUMENTS

| | | | |
|---|---|---|---|
| 2,669,675 | 2/1954 | Lawrence | 315/22 |
| 3,030,536 | 4/1962 | Hackett et al. | 313/80 |
| 4,495,437 | 1/1985 | Kume et al. | 313/403 |
| 4,725,756 | 2/1988 | Kaplan | 313/407 |
| 5,111,107 | 5/1992 | Kume et al. | 313/404 |

*Primary Examiner*—Sandra L. O'Shea
*Assistant Examiner*—Vip Patel
*Attorney, Agent, or Firm*—Joseph S. Tripoli; Dennis H. Irlbeck

[57] ABSTRACT

A color picture tube has a tensioned mask and a support frame, each of which is rectangular and has two long sides paralleling a central major axis and two short sides paralleling a central minor axis. The mask is cylindrically contoured, being curved along the major axis and straight along the minor axis. The support frame includes two first members paralleling the major axis and two second members attached to the ends of the first members and paralleling the minor axis. Each of the first members comprises a first part having two flanges, a first flange extending toward the screen and a second flange perpendicular to the first flange, in an L-shaped cross-section. The first flange varies in height along the first part, from a minimum height at the ends thereof to a maximum height at the center thereof. Each of the first members also comprises a second part which extends between the two flanges of the first part and forms a triangle therewith in cross-section.

6 Claims, 4 Drawing Sheets

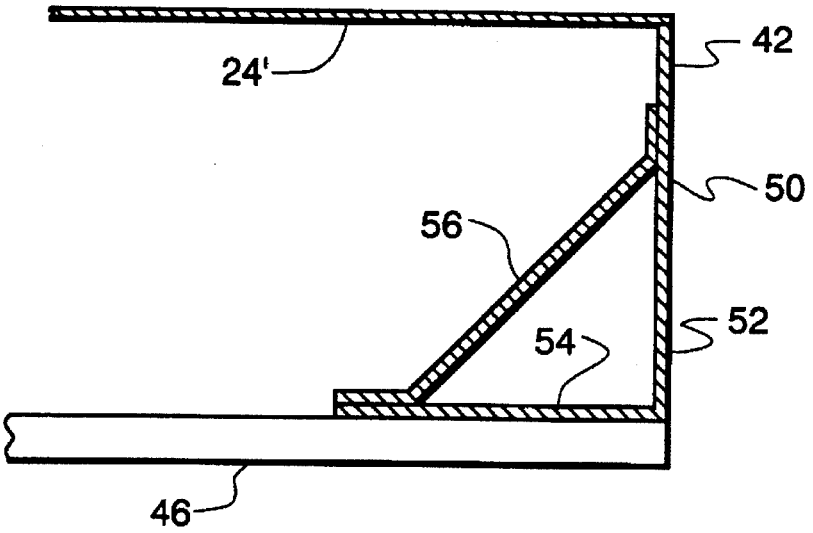
Fig. 6
Fig. 7
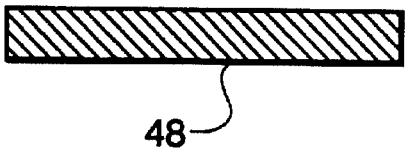
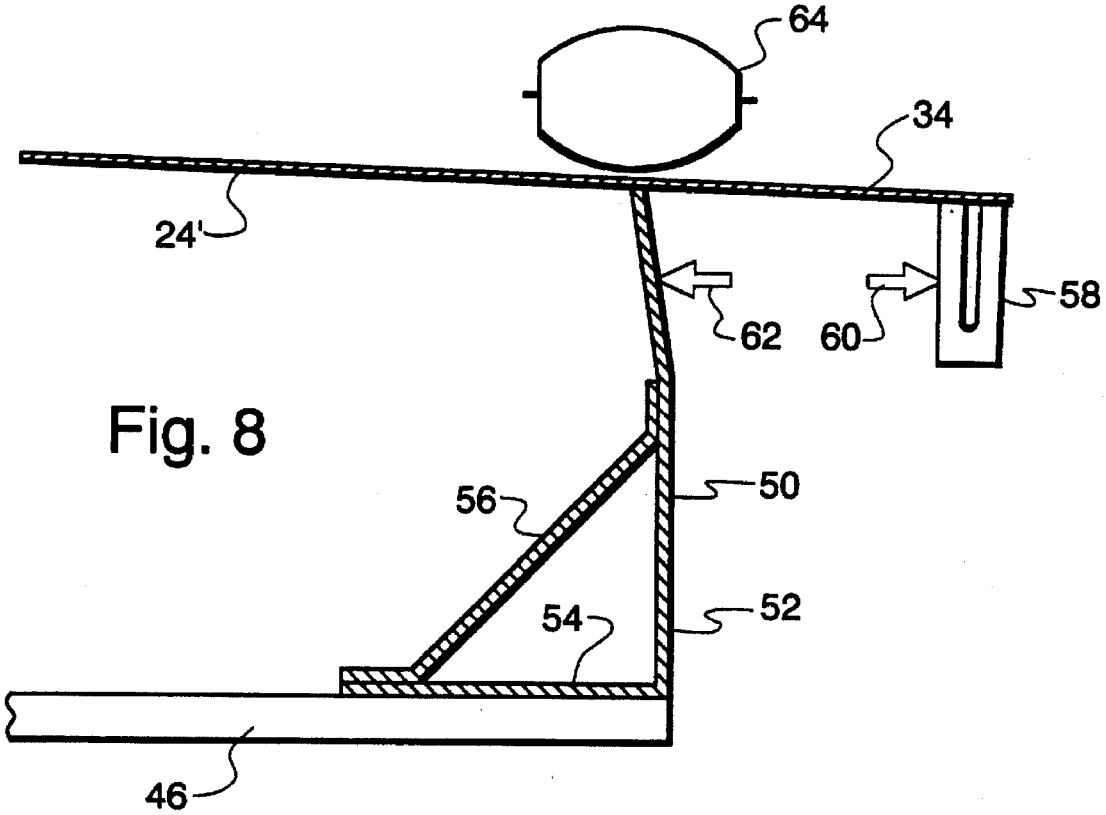
Fig. 8

COLOR PICTURE HAVING A TENSIONED MASK AND COMPLIANT SUPPORT FRAME ASSEMBLY

This invention relates to color picture tubes having tensioned masks attached to support frames, and particularly to a tube with a mask-frame assembly having a tensioned mask that is attached to a compliant support frame.

BACKGROUND OF THE INVENTION

A color picture tube includes an electron gun for forming and directing three electron beams to a screen of the tube. The screen is located on the inner surface of a faceplate of the tube and is made up of an array of elements of three different color emitting phosphors. An apertured mask, which may be either a shadow mask or a focus mask, is interposed between the gun and the screen to permit each electron beam to strike only the phosphor elements associated with that beam. A shadow mask is a thin sheet of metal, such as steel, that is contoured to somewhat parallel the inner surface of the tube faceplate. A focus mask comprises a dual set of conductive lines that are perpendicular to each other and usually separated by an insulative layer. Both shadow masks and focus masks can be constructed in the form of tensioned masks. A tensioned mask is a stretched mask that is maintained under tension by a support frame.

The frame used with a tension mask must have high compliance, both to keep the tensioned strands of the mask tight and to prevent over-stressing of the strands when the mask and its support frame encounter a range of temperatures during processing and tube operation. One existing design relieves mask tension during tube processing by bending of the side members of the frame. However, this design may result in a large variation in compliance between the center and sides of the mask. Such variation occurs because of uneven bending and twisting in the frame members, which ultimately causes a reduction in wire tension in some parts of the mask relative to the tension in other parts. Although tubes with such mask frames have found wide consumer acceptance, there is yet a need for further improvement in tubes, to reduce the weight and cost of the mask-frame assemblies used therein, while providing a compliant structure that is very resistant to bending and twisting.

SUMMARY OF THE INVENTION

The present invention provides an improvement in a color picture tube having a tensioned mask and a support frame, each of which is rectangular and has two long sides paralleling a central major axis and two short sides paralleling a central minor axis. The mask is cylindrically contoured, with the mask being curved along the major axis and straight along the minor axis. The improvement comprises the support frame including two first members paralleling the major axis and two second members, attached to the ends of the first members, paralleling the minor axis. Each of the first members comprises a first part having two flanges, a first flange extending toward the screen and a second flange perpendicular to the first flange, in an L-shaped cross-section. The first flange varies in height along the first pan, from a minimum height at the ends thereof to a maximum height at the center thereof. Each of the first members comprises also a second part, which extends between the two flanges of the first part and forms a triangle therewith in cross-section.

BRIEF DESCRIPTION OF THE DRAWINGS

FIG. 6 is a partial cross-section view of the mask-frame assembly taken at line 6—6 of FIG. 3.

FIG. 7 is a partial cross-sectional view of the frame taken at line 7—7 of FIG. 5.

FIG. 8 is a partial cross-sectional view of a mask-frame assembly during fabrication.

DETAILED DESCRIPTION OF THE PREFERRED EMBODIMENTS

Figure 1:
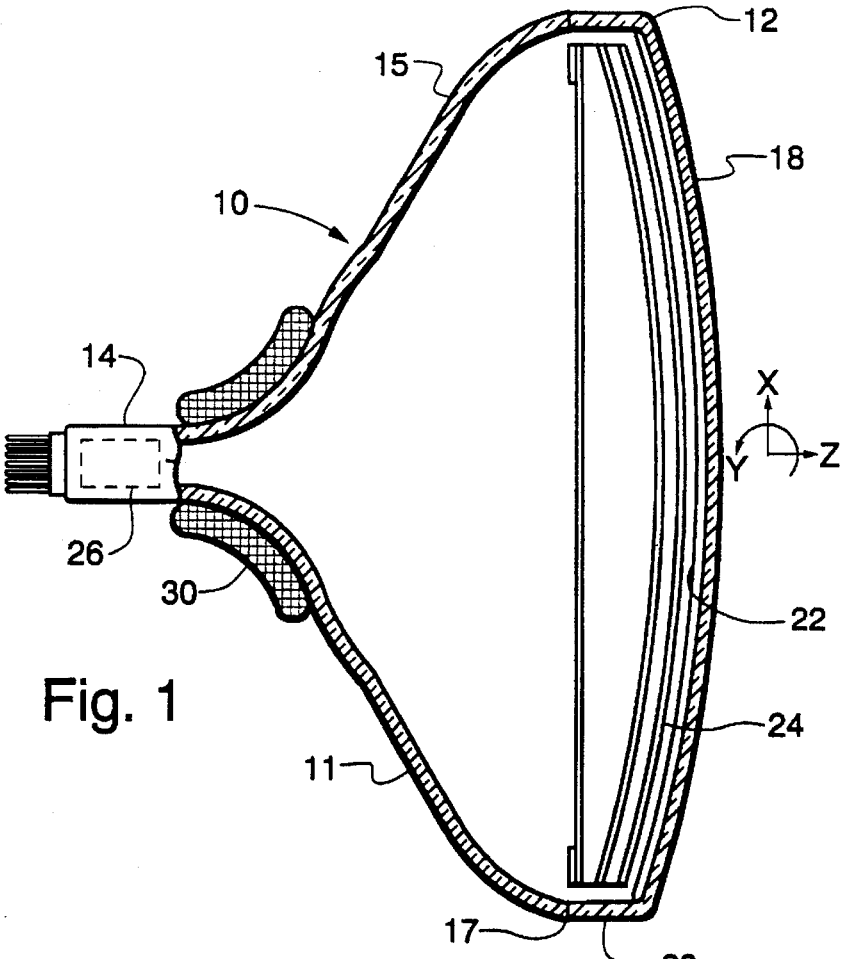
FIG. 1 is a top view, partly in axial section, of a color picture tube embodying the invention.
Figure 2:
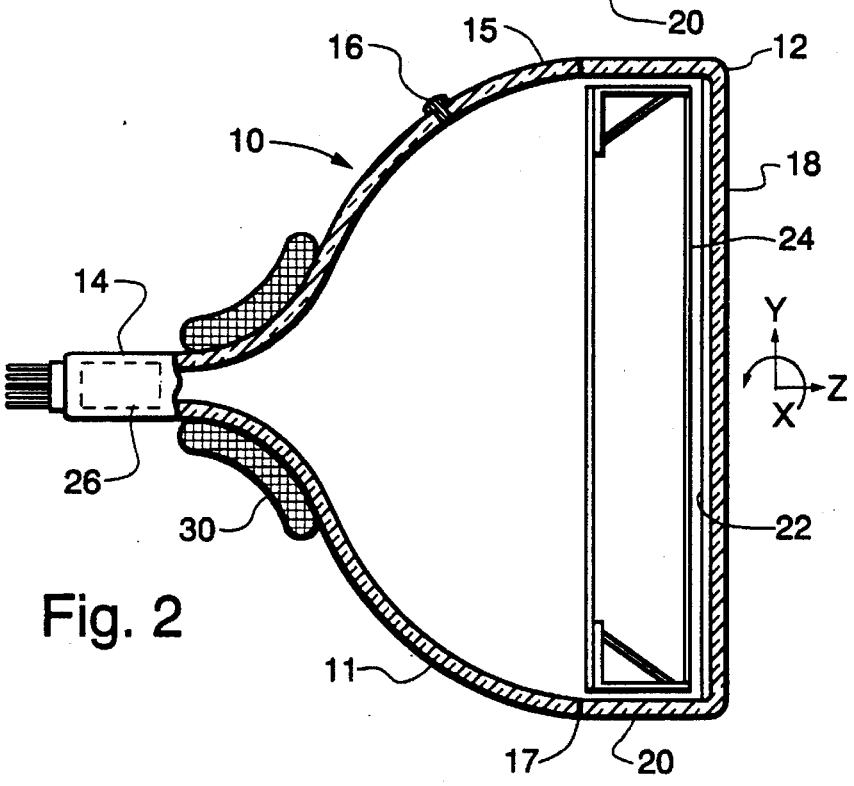
FIG. 2 is a side view, partly in axial section, of the color picture tube of FIG. 1.

FIGS. 1 and 2 show a color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a cylindrical viewing faceplate 18 and a peripheral flange or sidewall 20 which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A cylindrical tensioned mask 24 is removably mounted in predetermined spaced relation to the screen 22. The tensioned mask 24 may be either a shadow mask or a focus mask. An electron gun 26, shown schematically by dashed lines in FIGS. 1 and 2, is centrally mounted within the neck 14 to generate and direct three inline electron beams, a center beam and two side or outer beams, along convergent paths through the mask 24 to the screen 22.

The tube 10 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

Figure 3:
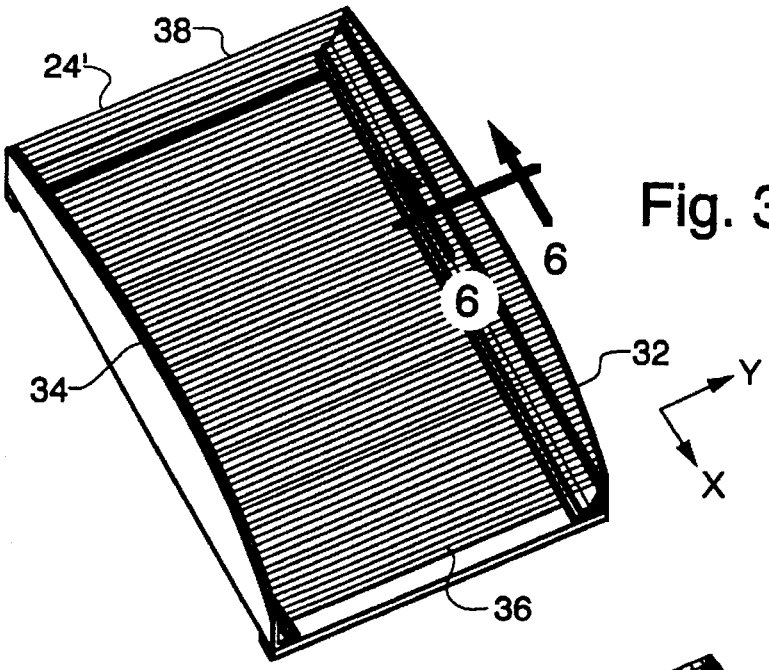
FIG. 3 is a perspective view of a tensioned shadow mask-frame assembly.
Figure 4:
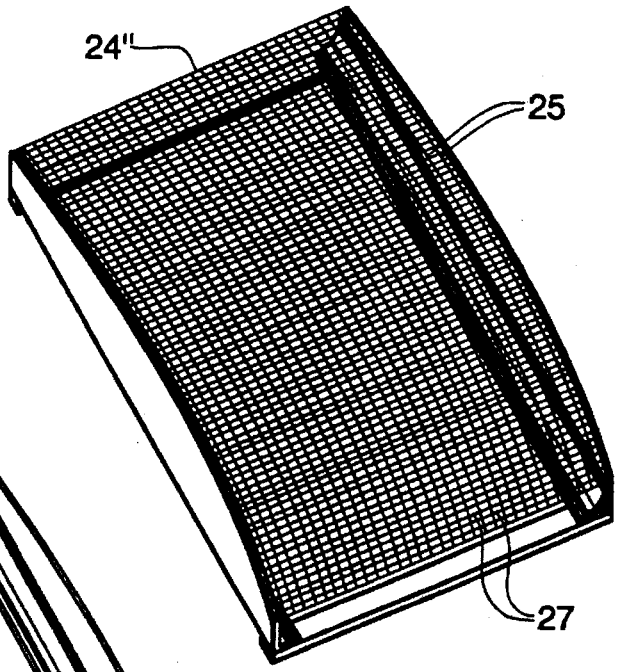
FIG. 4 is a perspective view of a tensioned focus mask-frame assembly.
Figure 5:
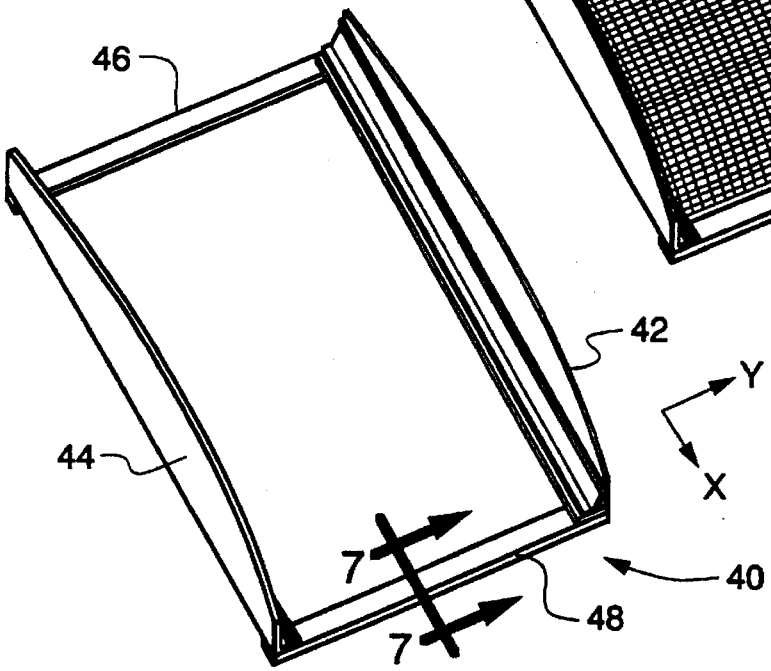
FIG. 5 is a perspective view of the frame of FIG. 3 with the mask removed.

When the tensioned mask is a shadow mask 24', as shown in FIG. 3, it includes an apertured portion that contains a multiplicity of elongated slits that parallel a central minor axis, Y, of the mask. Each slit extends from near one long side of the mask to near the other long side. The tensioned shadow mask 24' includes two long sides 32 and 34 and two short sides 36 and 38. The two long sides 32 and 34 parallel a central major axis, X, of the mask, and the two short sides 36 and 38 parallel the central minor axis, Y, of the mask. When the tensioned mask is a focus mask 24", as shown in FIG. 4, it includes a plurality of vertically extending strands 25, which are under tension, and a plurality of horizontally extending wires 27 that are separated from the strands 25 by insulators (not shown), A frame 40, for use with either the tension or focus mask, is shown in FIGS. 5, 6 and 7. The frame 40 is rectangular and includes four major members, two first members 42 and 44 that substantially parallel the major axis X, and two second members 46 and 48 that substantially parallel the minor axis Y. Each of the first members 42 and 44 includes a first part 50 having two flanges, a first flange 52 that extends toward the screen, and a second flange 54 that is perpendicular to the first flange 52. The two flanges are configured in an L-shaped cross-section. The first flange 52 varies in height along the first part 50, from a minimum height at the ends of the first part to a maximum height at the center of the first part. Each first member 42 and 44 also includes a second part 56 that is angled between the two flanges 52 and 54 of the first part 50, to form a triangle therewith in cross-section. The second part 56 intersects the first flange 52 a predetermined distance from the distal end of the flange 52, to permit some flexibility of the cantilevered portion of the flange 52.

A method of attaching the mask 24' to the distal end of the first flange 52 is shown in FIG. 8. First, the long sides 32 and 34 of the mask are held by two vacuum supports 58 (one shown), that are moved apart, as shown by force vector 60, to put the mask under tension. At the same time, the distal ends of the first flanges 52 are bent toward each other, as shown by force vector 62, with the distal ends in contact with the mask. Next, a welding head 64 is moved along the mask, welding the mask to the distal ends of the first flanges 52. Finally, the vacuum supports 58 are removed and the excess portion of the mask is separated therefrom. The spring-back of the distal ends of the flanges 52, after removal of the force vector 62, maintains the mask under tension.

Figure 9:
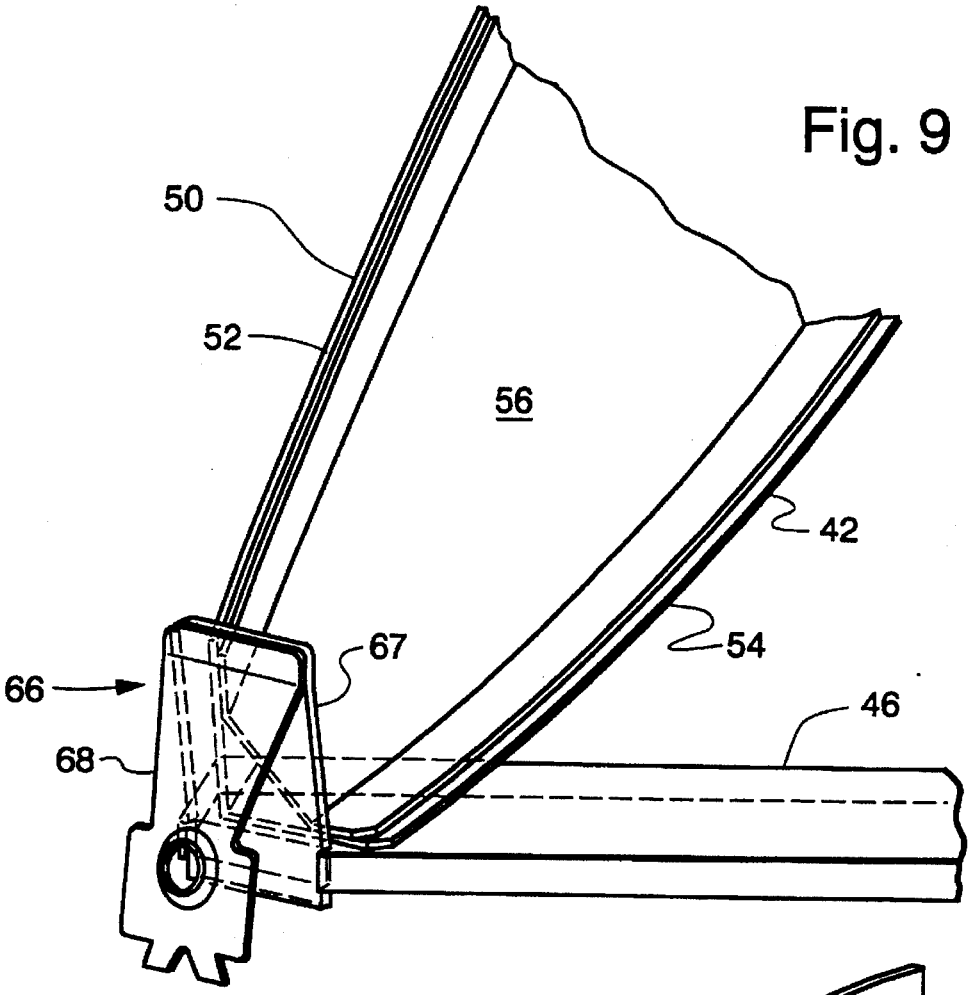
FIG. 9 is a partial perspective view of a frame with a corner support assembly.

FIG. 9 shows a comer support assembly 66 that can be used with the frame 40. In this embodiment, the two second members 46 and 48 are formed from solid metal bars, and the ends thereof are angled with respect to the major and minor axes, X and Y. These ends may either be perpendicular or nearly perpendicular to the frame diagonals, which extend between opposite comers of the frame. The support assembly includes a plate 67 and spring 68. The bottom of the plate 67 is welded to the angled ends of the second member 46, and the spring 68 is welded to the distal end of the plate 67. An aperture in the spring 68 engages a stud, which is located in a comer of the faceplate panel of the tube.

Figure 10:
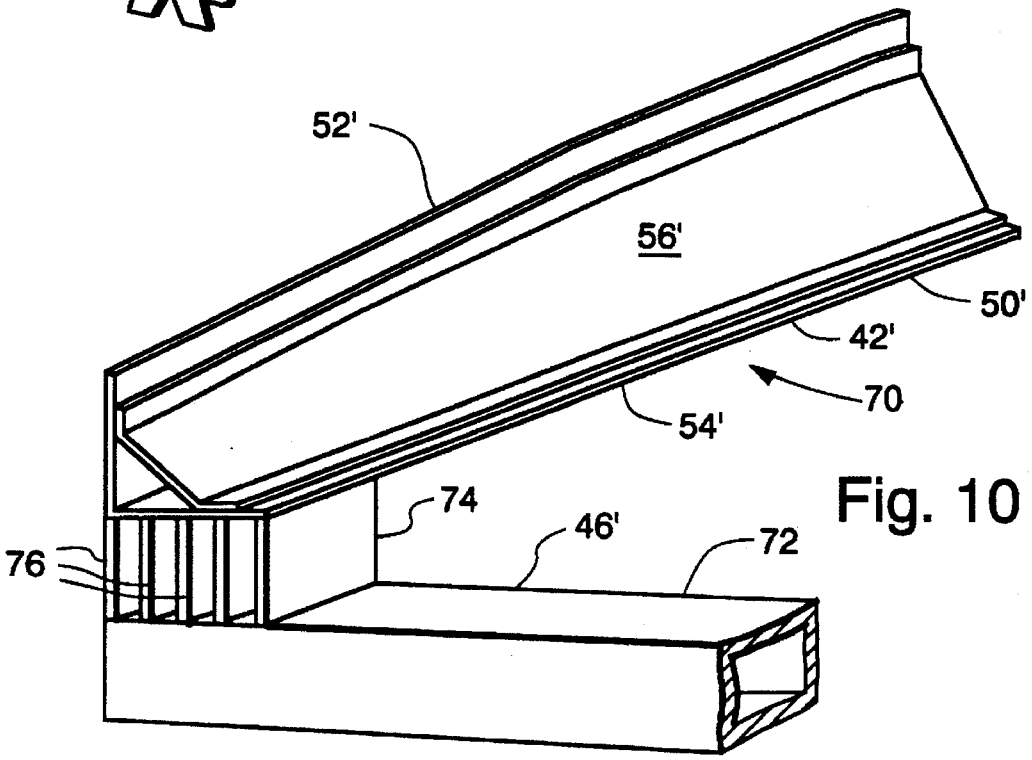
FIG. 10 is a partial perspective view of another frame embodiment, showing the use of pantographs between two portions of the frame.

Another frame 70 is shown in FIG. 10. The design of the frame 70 differs somewhat from that of the frame 40. Like the frame 40, the first members 42' along the long sides of the frame 70 include a first part 50' having two flanges configured in an L-shaped cross-section, a first flange 52' that extends toward the screen and a second flange 54' that is perpendicular to the first flange 52'. The first members 42' also include a second part 56' that is angled between the two flanges 52' and 54' of the first part 50', to form a triangle therewith in cross-section. The second part 56' intersects the first flange 52' a distance from the distal end of the flange 52', to permit some flexibility of the cantilevered portion of the flange 52'. However, unlike the frame 40, the frame 70 includes rectangularly shaped hollow pipes 72, instead of solid bars, as second members 46' along its short sides. These pipes could also be substituted into the first frame 40, in place of the solid bars. A big difference between the frame 70 from the frame 40 is the interconnection between the first and second members. In the frame 70, this interconnection is made by means of pantographs 74, wherein each pantograph comprises a plurality of parallel plates 76. The function of the pantographs 74 is to allow the top and bottom first members 42' to move nearer or farther from each other without any rotation of the first members. This permits frame compliance to be substantially constant along the lengths of the top and bottom first members. The pantograph height, width, thickness and plate numbers are determined by the available space and force and compliance needed. In general, the available space controls the height and width, the force controls the plates number and compliance controls the thickness.

What is claimed is:

1. In a color picture tube having a tensioned mask and support frame assembly, each of said mask and said support frame being rectangular and having two long sides paralleling a central major axis thereof and two short sides paralleling a central minor axis thereof, and said mask having a cylindrical contour, being curved along said major axis and straight along said minor axis, the improvement comprising said frame including two first members paralleling said major axis and two second members attached to the ends of said first members and paralleling said minor axis, each of said first members comprising a first part having two flanges, a first flange extending toward said screen and a second flange being flat and perpendicular to said first flange, in an L-shaped cross-section, said first flange varying in height from said second flange along said first part from a minimum height at the ends thereof to a maximum height at the center thereof, and each of said first members comprising a second part extending between said first and second flanges of said first part and forming a triangle therewith in cross-section, said second part intersecting the first flange of said first part a predetermined distance from a distal end of said first flange.

2. The color picture tube as defined in claim 1, wherein said tensioned mask is a shadow mask.

3. The color picture tube as defined in claim 1, wherein said tensioned mask is a focus mask.

4. In a color picture tube having a tensioned mask and support frame assembly, each of said mask and said support frame being rectangular and having two long sides paralleling a central major axis thereof and two short sides paralleling a central minor axis thereof, and said mask having a cylindrical contour, being curved along said major axis and straight along said minor axis, the improvement comprising said frame including two first members paralleling said major axis and two second members attached to the ends of said first members and paralleling said minor axis, each of said first members comprising a first part having two flanges, a first flange extending toward said screen and a second flange being flat and perpendicular to said first flange, in an L-shaped cross-section, said first flange varying in height from said second flange along said first part from a minimum height at the ends thereof to a maximum height at the center thereof, each of said first members comprising a second part extending between said first and second flanges of said first part and forming a triangle therewith in cross-section, said second part intersecting the first flange of said first part a predetermined distance from a distal end of said first flange, and wherein said second members have angled ends and support spring assemblies are attached to the angled ends of said second members.

5. The tube as defined in claim 4, wherein said second members are solid metal bars.

6. In a color picture tube having a tensioned mask and support frame assembly, each of said mask and said support frame being rectangular and having two long sides paralleling a central major axis thereof and two short sides paralleling a central minor axis thereof, and said mask having a cylindrical contour, being curved along said major axis and straight along said minor axis, the improvement comprising said frame including two first members paralleling said major axis and two second members attached to the ends of said first members and paralleling said minor axis, each of said first members comprising a first part having two flanges, a first flange extending toward said screen and a second flange being flat and perpendicular to said first flange, in an L-shaped cross-section, said first flange varying in height from said second flange along said first part from a minimum height at the ends thereof to a maximum height at the center thereof, each of said first members comprising a second part extending between said first and second flanges of said first part and forming a triangle therewith in cross-section, said second part intersecting the first flange of said first part a predetermined distance from a distal end of said first flange, and wherein said first and second members are connected by pantographs, each pantograph comprising a plurality of parallel plates.

* * * * *

UNITED STATES PATENT AND TRADEMARK OFFICE

CERTIFICATE OF CORRECTION

PATENT NO. : 5,644,192

DATED : July 1, 1997

INVENTOR(S) : Frank Rowland Ragland, Jr.

It is certified that error appears in the above-identified patent and that said Letters Patent is hereby corrected as shown below:

On title page, item [54] and column 1, lines 1-3

In the Title: "COLOR PICTURE HAVING A TENSIONED MASK AND COMPLIANT SUPPORT FRAME ASSEMBLY", should read -- COLOR PICTURE TUBE HAVING A TENSIONED MASK AND COMPLIANT SUPPORT FRAME ASSEMBLY -- .

Signed and Sealed this

Twenty-fourth Day of March, 1998

*Attest:*

Bruce Lehman

BRUCE LEHMAN

*Attesting Officer*

*Commissioner of Patents and Trademarks*